US005123165A

United States Patent [19]

Strong et al.

[11] Patent Number: 5,123,165

[45] Date of Patent: Jun. 23, 1992

[54] METHOD OF DETERMINING THE CRIMP HEIGHT OF A CRIMPED ELECTRICAL CONNECTION

[75] Inventors: Michael D. Strong, Mechanicsburg; Michael A. Yeomans, Camp Hill, both of Pa.

[73] Assignee: AMP Incorporated, Harrisburg, Pa.

[21] Appl. No.: 674,278

[22] Filed: Mar. 21, 1991

[51] Int. Cl.[5] ..... H01R 43/04

[52] U.S. Cl. ..... 29/861; 29/705; 29/720; 29/748; 29/753; 29/863

[58] Field of Search ..... 29/861, 863, 857, 407, 29/753, 720, 748, 705; 72/430, 431, 465

[56] References Cited

U.S. PATENT DOCUMENTS 4,856,186 8/1989 Yeomans ..... 29/863

4,916,810 4/1990 Yeomans ..... 29/863

FOREIGN PATENT DOCUMENTS 60-246579 12/1985 Japan ..... 29/593

*Primary Examiner*—Carl J. Arbes

*Attorney, Agent, or Firm*—James M. Trygg

[57] ABSTRACT

The present invention is a method of determining the crimp height of an electrical terminal being crimped to a wire during the production crimping cycle. The method includes collecting a plurality of force and position data element pairs which are measured and sampled during the actual crimping operation. These data element pairs, representing the work curve of the operation and are analyzed to find the position of the ram when the crimping die set just disengages the terminal being crimped. The position of the ram at this point is then translated into the crimp height of the crimped connection. The analysis of the data element pairs includes a filter to remove inconsistent or extraneous data element pairs which could adversely affect the result by indicating an erroneous crimp height.

9 Claims, 7 Drawing Sheets

METHOD OF DETERMINING THE CRIMP HEIGHT OF A CRIMPED ELECTRICAL CONNECTION

FIELD OF THE INVENTION

This invention relates to the termination of terminals to respective wires and to the measuring of crimp height of such terminations.

BACKGROUND OF THE INVENTION

Terminals are typically crimped onto wires by means of a conventional crimping press having an anvil for supporting the electrical terminal and a die that is movable toward and away from the anvil for effecting the crimp. In operation, a terminal is placed on the anvil, an end of a wire is inserted into the ferrule or barrel of the terminal, and the die is caused to move toward the anvil to the limit of the stroke of the press, thereby crimping the terminal onto the wire. The die is then retracted to its starting point.

In order to obtain a satisfactory crimped connection, the crimp height and other characteristics of the crimped terminal must be closely controlled. The crimp height of a terminal is a measure of height or maximum vertical dimension of a given portion of the terminal after crimping. Ordinarily, if a terminal is not crimped to the correct crimp height for the particular terminal and wire combination, an unsatisfactory crimped connection will result.

A simple non-destructive means of determining crimp height during the crimping process is disclosed in U.S. Pat. No. 4,856,186 which issued Aug. 15, 1989 to Yeomans and U.S. Pat. No. 4,916,810 which issued Apr. 17, 1990 to Yeomans, both of which are incorporated by reference as though set forth verbatim herein. The '186 patent sets forth a procedure for determining the crimp height by monitoring the ram position and the force imposed on the terminal during the crimping operation. As the crimping dies engage the terminal and crimping begins, the crimp force builds up to a peak and then begins to recede. At the exact instant that the receding force reaches zero, the position of the ram is noted and the distance between the two mating halves of the crimping die set is calculated. This is then translated into the crimp height of the crimped connection. Such a procedure assumes that at the instant the force equals zero that the mating halves of the die set are just beginning to disengage the crimped terminal. FIG. 3 shows a work curve graph which illustrates this. There, the graph 5 depicts the relationship of the crimp force on the terminal with respect to displacement of the ram. As the crimping die set engages the terminal to begin the crimp, the force begins to increase as shown at E1. The force reaches a peak at E2 and then falls off as the crimping die set halves begin to separate. As this force fall-off continues, the normal expectation would be that the point E3 would be the point where the force recedes to zero, however, this is not the case. As can be seen in the graph 5, as the force recedes close to zero the force fall-off becomes slowed somewhat causing a sharp turn in the graph 5 and does not actually reach zero until the point E4 is reached. If the crimp height is calculated based upon the point E4, an erroneous crimp height will result.

What is needed is a procedure for avoiding such a result and, at the same time, utilizing the information yielded by the graph 5 between the points E2 and E3 to more accurately determine the crimp height. Such a procedure could then be utilized in automated terminating machines to provide reliable feedback of machine performance so that corrective adjustments may be made prior to adversely affecting production. Such feedback and corrective adjustments in automated crimping machines are disclosed in the above-mentioned '810 patent as well as U.S. Pat. Application Ser. No. 07/529,036 filed May 25, 1990 by the assignee of the present application and which is incorporated by reference as though set forth verbatim herein.

SUMMARY OF THE INVENTION

The present invention is a method of determining the crimp height of an electrical terminal crimped onto a wire either during the crimping process or immediately thereafter. A terminal and wire to be crimped are placed into a crimping apparatus and the apparatus actuated. During the engaging, crimping, and disengaging of the crimping apparatus with the terminal, both the distance between the terminal engaging portions of the crimping die set and the force applied to the terminal are simultaneously measured for a plurality of different relative positions of the mating halves of the die set thereby defining a plurality of measured force and position data element pairs. The plurality of data element pairs are examined and after a predetermined peak force is reaches, data element pairs are selected from the remaining ones having a force value less than the peak force and greater than zero. A least square analysis is then performed on the selected pairs to define a line. The intercept of the defined line with respect to the position axis is determined and then translated into the crimp height.

DESCRIPTION OF THE PREFERRED EMBODIMENT

Figure 1:
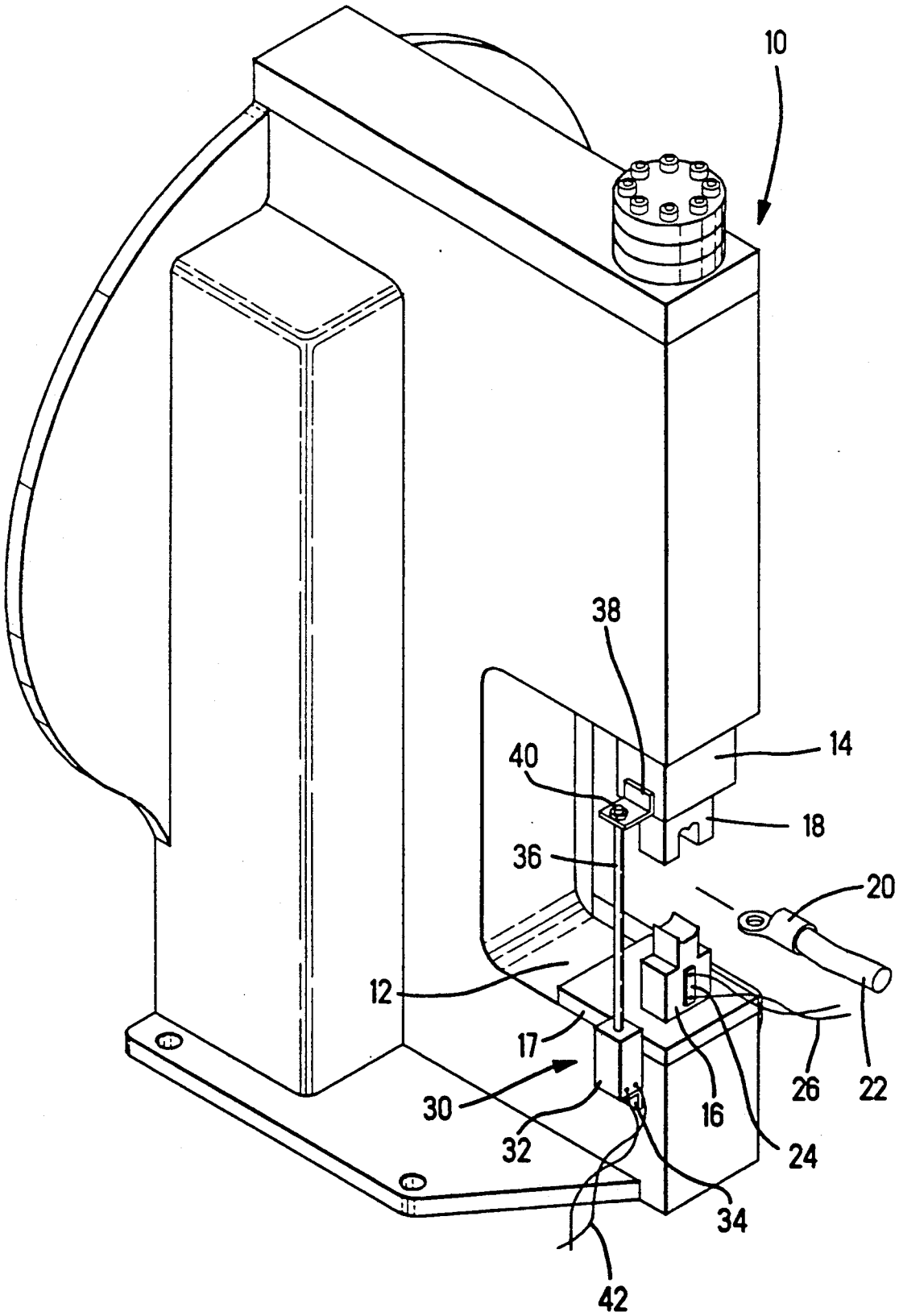
FIG. 1 is an isometric view of a crimping apparatus.

There is shown in FIG. 1 a crimping press 10 having a base 12 and a ram 14 arranged for reciprocating opposed motion relative to the base 12. The crimping press 10, in the present example, is the type having a flywheel and clutch arrangement for imparting the reciprocating motion to the ram 14, however, other types of presses having a suitable ram stroke may be used in the practice of the present invention.

The base 12 and ram 14 each carry a mating half of a crimping die set in the usual manner. The die set includes an anvil 16 which is removably attached to a base plate 17 and a punch 18 which is removably attached to the ram 14, as shown in FIG. 1. The base plate 17 is coupled to the base 12 in a manner that will permit vertical movement of the plate 17. A typical terminal 20 is shown, in FIG. 1, crimped onto a wire.

As shown in FIG. 1, a strain gage 24 is attached to the anvil 16 in the usual manner by epoxy or soldering. A pair of leads 26 carry a signal that is proportional to the stress placed on the anvil 16 which is transferred from the ram 14, through the terminal 20 and wires 22 being crimped, to the anvil 16. The signal appearing on the leads 26 is indicative of the force imposed upon the terminal 20 during crimping, as set forth in more detail in the aforementioned '186 patent.

A linear distance sensor 30 is arranged to measure displacement of the ram 14 with respect to the base 12. The sensor 30 includes a stator 32, which is rigidly attached to the base 12 by a suitable bracket 34, and an armature which is movable within the stator in the vertical direction as viewed in FIG. 1. A push rod 36 projects upwardly from the stator 32 and has one end attached to the movable armature and the other end adjustably attached to the ram 14 by means of a suitable bracket 38 and adjusting nut 40. A pair of leads 42 carry a signal that is proportional to the vertical position of the armature within the stator. This signal is indicative of the vertical distance between the anvil 16 and the punch 18 as set forth in more detail in the '186 patent. As explained there, by monitoring the signals on the leads 26 and 42, the actual crimp height of the crimped terminal 20 can be accurately determined. It will be understood that the signal on the lead 42 is also indicative of the amount of deformation of the terminal being crimped by the anvil 16 and punch 18. Additionally, other parameters may be determined as well, such as peak force exerted on the terminal 20 and the amount of work performed to complete the crimp.

The method and apparatus for measuring force and ram displacement and generating their respective signals on the leads 26 and 42, as described above, is by way of example only. Any suitable devices that are well-known in the art may be utilized for these functions. For example, permanent magnets may be associated with the ram and a hall effect device attached to the base and arranged to sense the relative position of the magnets in place of the sensor 30. Additionally, the strain gage 24 may be attached to the punch 18 instead of to the anvil 16. Other suitable devices for sensing and signaling force and ram displacement will occur to those skilled in the art and may be advantageously applied to practice the teachings of the present invention.

Figure 2:
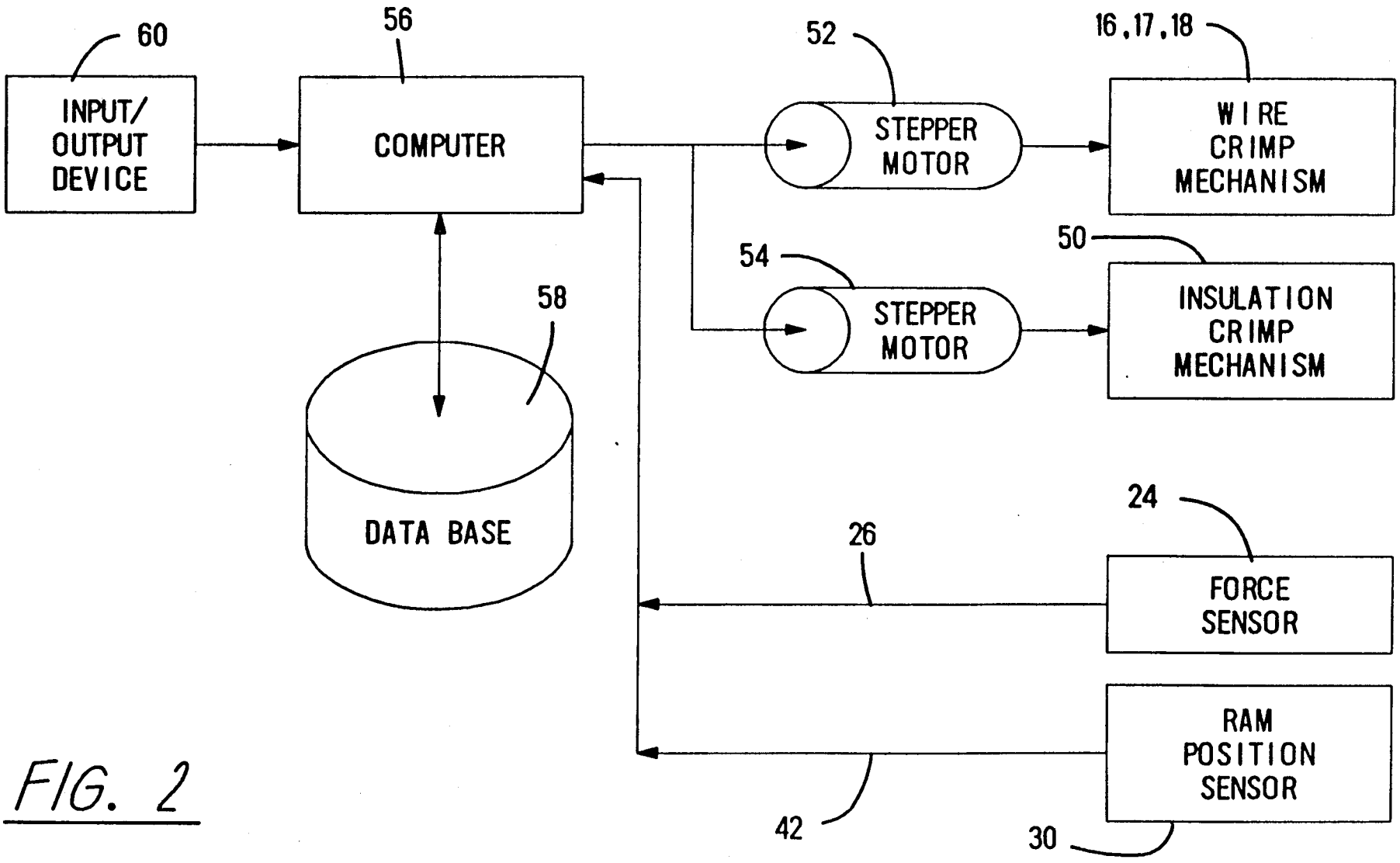
FIG. 2 is a block diagram showing typical functional elements of the crimping apparatus of FIG. 1 which may be utilized in the practice of the present invention.

The major functions of the machine are shown in FIG. 2. Note that the wire crimping mechanism is identified as 16, 18, and 17 which represent the anvil, punch, and movable base plate respectively, and the force and ram position sensors are identified as 24 and 30 which represent the strain gage and linear distance sensor respectively. An insulation crimping mechanism 50 is depicted in FIG. 2 as an example of other instrumentalities that may be controlled in a manner similar to that of the wire crimping mechanism. Other similar instrumentalities may also be controlled in a similar way. The actual adjusting means which physically moves or adjusts the base plate 17, in the case of the wire crimp mechanism, or another adjustable device in the case of the insulation crimp mechanism, are driven by stepper motors 52 and 54 respectively. Any suitable actuator which can be driven through a computer input/output channel may be substituted for the stepper motors 52 and 54. A computer 56 having a storage device 58 associated therewith for storing a data base and an input/output device 60 for operator communication, is arranged to drive the stepper motors 52 and 54. This is done in response to operator input through the device 60 and input from either the force sensor 24 or the ram position sensor 30.

Figure 3:
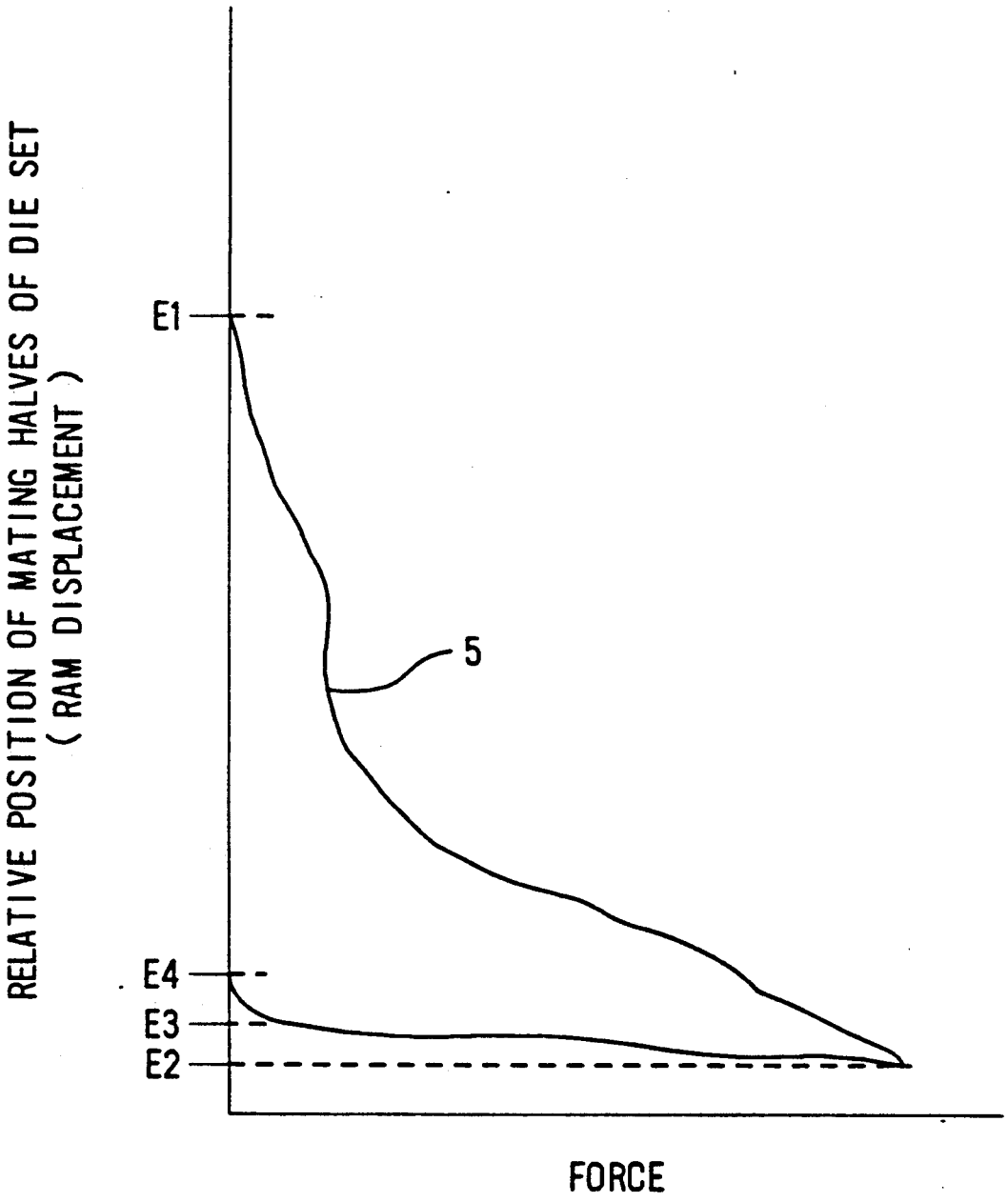
FIGS. 3 and 4 each show a graph relating crimp force to ram displacement during the crimping of a terminal onto a wire.

The signal appearing on the leads 26, which is indicative of the force imposed upon the terminal, and the signal appearing on the leads 42, which is indicative of the relative position of the mating halves of the crimping die set 16 and 18, are monitored by the computer 56 and recorded on the storage device 58 in a manner that is well known in the art. These signals are recorded as pairs of data elements, one pair for each discrete increment of time during the crimping cycle, a rate of 4000 samples per second, for example, was successfully utilized. The precise number of samples recorded is unimportant as long as a sufficient number are available to define a work curve 100, as shown in FIG. 3, having a position axis and a force axis, where the area under the curve represents the total work done during the crimp cycle. Alternatively, the samples may be taken based upon incremental changes in the values of either relative position or force instead of increments of time. The important consideration is that a sufficient number of samples are obtained to adequately define the work curve 5 of FIG. 3.

Figure 4:
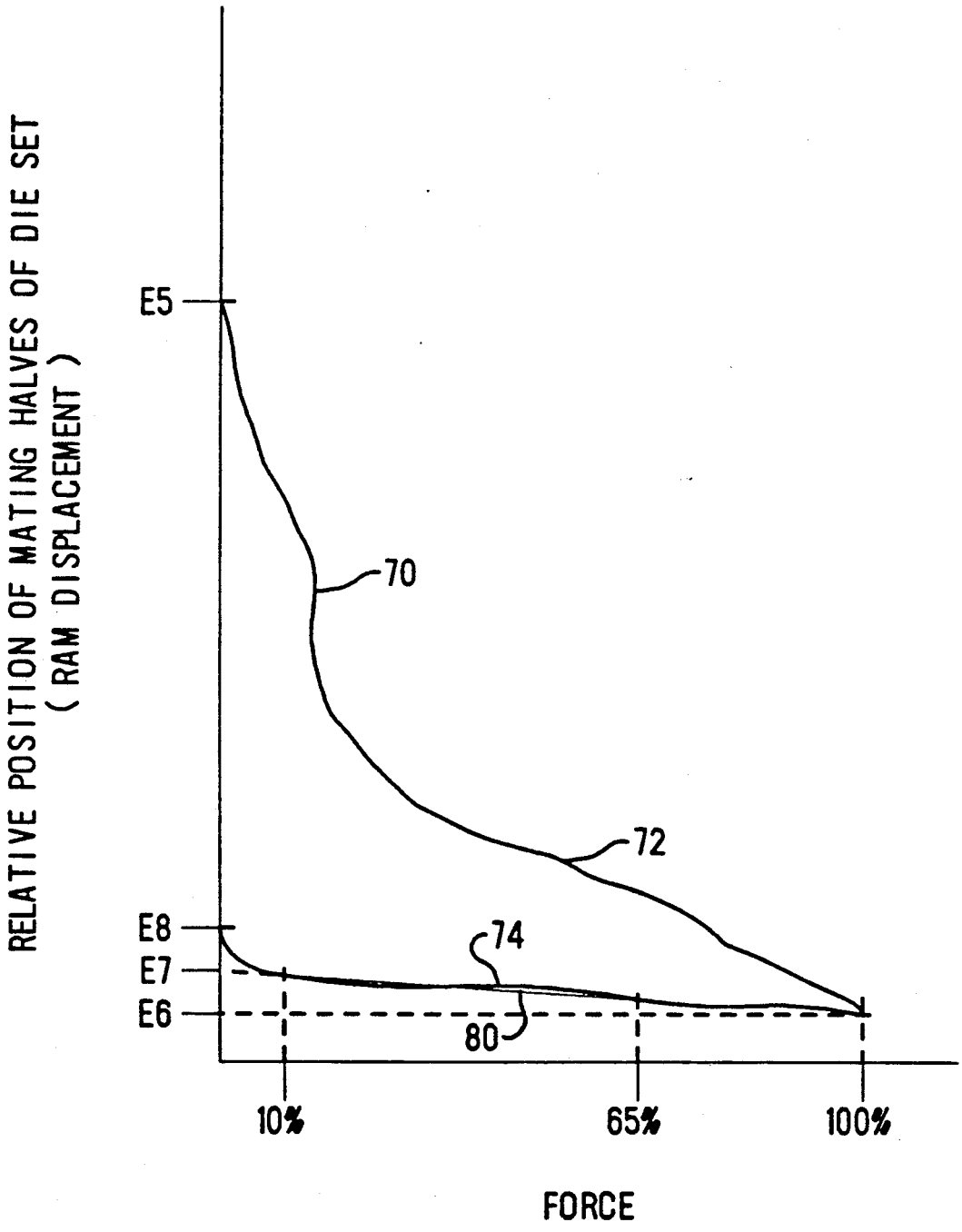

The curve 70, shown in FIG. 4, is a plot of a set of force and position data element pairs, similar to those of the work curve 5 of FIG. 3. The curve 70, hypothetically, represents the work curve of the crimping operation of a typical crimped terminal. The portion 72 of the work curve 70 between the points E5 and E6 on the position axis represent the forces resulting from the punch 18 of the mating die halves engaging the terminal 20 and deforming it against the anvil 16. The force reaches its peak at E6 where the punch 18 begins to disengage by withdrawing from the anvil 16. This disengagement, which is represented by the portion 74 of the work curve 70, continues from the point E6 to the point E8 where the force has receded to substantially zero. It is this portion 74 of the work curve 70 that is most significant in determining the crimp height of a crimped terminal.

A group of force and position data element pairs is selected from those that define the portion 74. As stated above, as the force approaches zero, the portion 74 sharply curves out of general alignment with the remainder of the portion 74. Therefore, the selected data element pairs should exclude those points that represent this sharp curve. Further, as the force reaches its peak at the point E6 and just begins to fall off, again, these data element pairs deviate from the general alignment of the portion 74 and should be excluded from those selected. By selecting data element pairs having a force value of from about 10 percent to about 65 percent of the peak force at point E6, these two areas of the portion 74 which deviate from the general alignment can be avoided. These force value percentage limits are not critical as long as the group of selected data element pairs does not include either extreme end when deviations occur.

Prior to utilizing this set of selected data element pairs to determine the crimp height of the terminal represented by the work curve 70, the set should be filtered to remove inconsistent or extraneous data element pairs which could adversely affect the result by indicating an inaccurate crimp height. This is accomplished by correlation analysis to establish the degree of relationship of the selected data element pairs in the set. This degree of relationship is usually expressed in a number having a value that ranges between $-1$ to $+1$ where $-1$ indicates perfect negative correlation, 0 indicates no correlation, and $+1$ indicates perfect positive correlation. The covariance of the force and position of the selected data element pairs in the set can be calculated as follows:

$$R^2 = \frac{(n(\Sigma Fh) - (\Sigma F)(\Sigma h))^2}{(n(\Sigma F^2) - (\Sigma F)^2)(n(\Sigma h^2) - (\Sigma h)^2)};$$

where R is the covariance, n is the number of data element pairs in the set, and F and h are the force and position values respectively. This equation is well-known in the art and will be found in a similar form in most texts on the subject.

In the present example, as shown in FIG. 4, as the ram 14 retracts, the punch 18 withdraws from the point E6 where the force F is a maximum to the point E8 where the force F is substantially zero. The measured force and position data element pairs contained in the set, as discussed above, are limited to those having force values of between 10 percent and 65 percent of the maximum force at E6. $R^2$ is then calculated, using the above equation, for the set of data element pairs and the result compared to a predetermined standard which, in the present example is 0.98. If $R^2$ is equal to or greater than 0.98, then the degree of relationship of the selected data element pairs in the set is satisfactory and the crimp height may now be determined. However, should $R^2$ be too small then an iterative process of temporarily removing a data element pair from the set, recalculating $R^2$, and then returning the data element pair to the set must be performed for all of the data element pairs to identify the data element pairs which contributed to the lowest value for $R^2$. This data element pair is then permanently removed from the set and a new $R^2$ for the set is calculated. Should this new $R^2$ be too small, then the iterative process is repeated for as many times as is required to achieve an acceptable $R^2$ value. In the event that the number of data element pairs in the set is reduced to some predetermined low limit, 4 in the present example, then there are too few points present to provide a valid result. However, such cases are very unlikely to occur.

Assuming that the set of selected data element pairs has been successfully reduced to obtain an acceptable $R^2$ value, the crimp height may now be determined. This is done by fitting a line to the set of data element pairs and then finding the intercept of that line with the position axis as shown at E7 of FIG. 4. One method of fitting a line is well-known in the art as the "least squares" method. By way of background, the "least squares" method may be performed as follows:

For a set of n points of the form $(F_i,P_i)$ the slope m and intercept b of the straight line are given by $$m = \frac{1}{d}\left(n \sum_{i=1}^{n} F_iP_i - \sum_{i=1}^{n} F_i \sum_{i=1}^{n} P_i\right)$$

$$b = \frac{1}{d}\left(\sum_{i=1}^{n} F_i^2 \sum_{i=1}^{n} P_i - \sum_{i=1}^{n} F_i \sum_{i=1}^{n} F_iP_i\right)$$

$$d = n \sum_{i=1}^{n} F_i^2 - \left(\sum_{i=1}^{n} F_i\right)^2$$

Once a line 80 is defined that best fits the set of selected data element pairs, as shown in FIG. 4, the intercept b is found, as indicated at E7 of FIG. 4. It will be appreciated by those skilled in the art that the method of least squares is not limited to linear situations, but may advantageously be utilized in the practice of the present invention, to fit a line of a multi-degree polynomial should the set of selected data element pairs so require. In the present example it was found that the set of selected data element pairs is somewhat linear and, therefore, lends itself to the above linear method.

The intercept b is then translated into the crimp height of the terminal by simply adding to it an offset number which was previously determined during calibration of the apparatus. The calibration may be performed by preparing a suitable number of samples of correctly stripped wires and associated terminals to be crimped thereto. A wire and corresponding terminal is placed in crimping position within the press 10 and crimped while recording the data element pairs representing the work curve of the crimping operation. The crimped terminal and wire assembly is then removed from the press and the crimp height is measured by conventional measuring means and the measured value is entered into the computer 56. The difference between the calculated intercept b and the actual measured crimp height is determined and stored by the computer 56 as an offset value. Such an offset value is determined for each of the samples and averaged. This average offset value is then used during the operation of the press 10 to translate the intercept b of a crimped terminal to its corresponding crimp height by adding the offset value to the intercept b.

Figure 5:
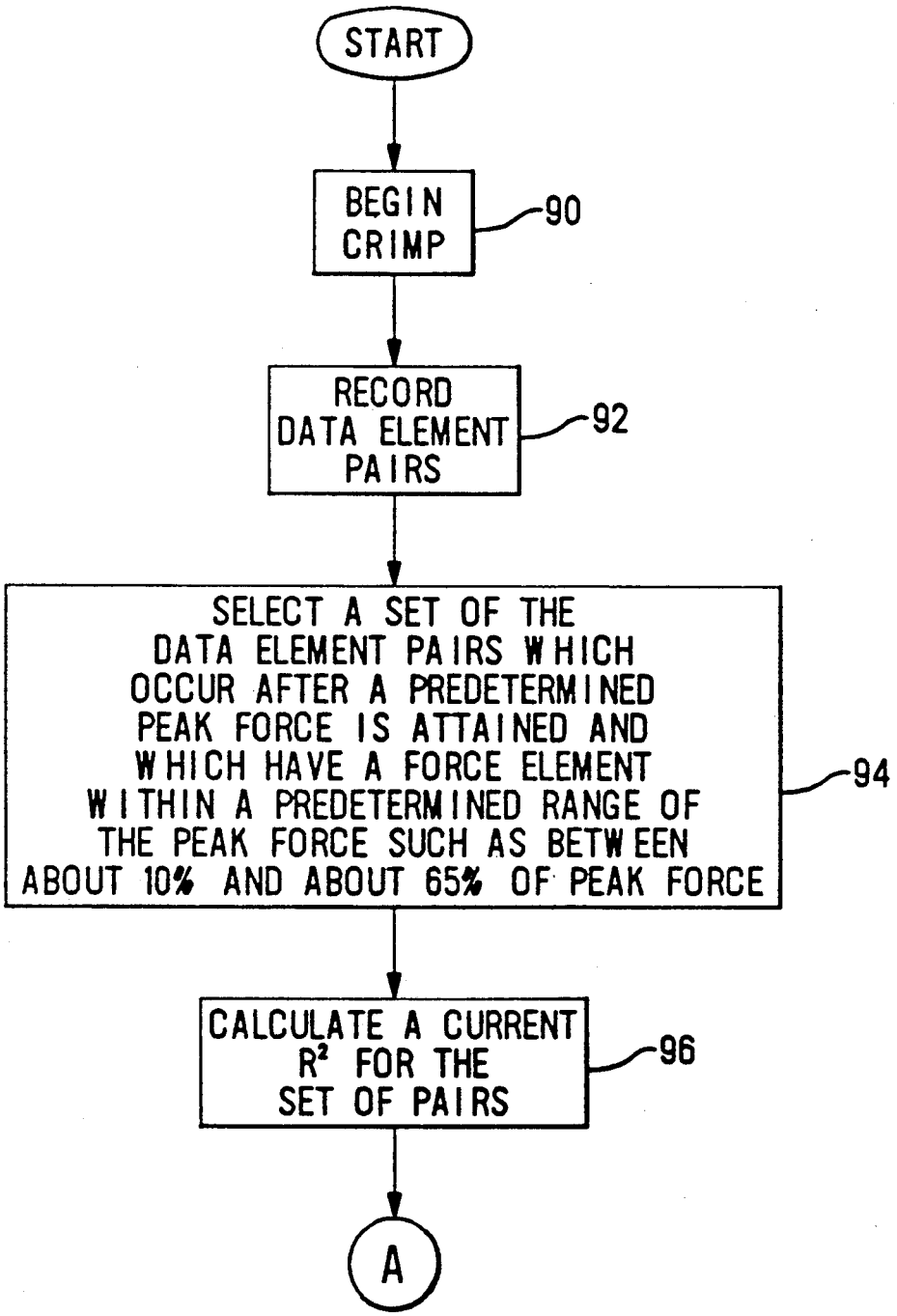
FIGS. 5, 6 and 7 show a logic flow diagram illustrating a method of the present invention.
Figure 6:
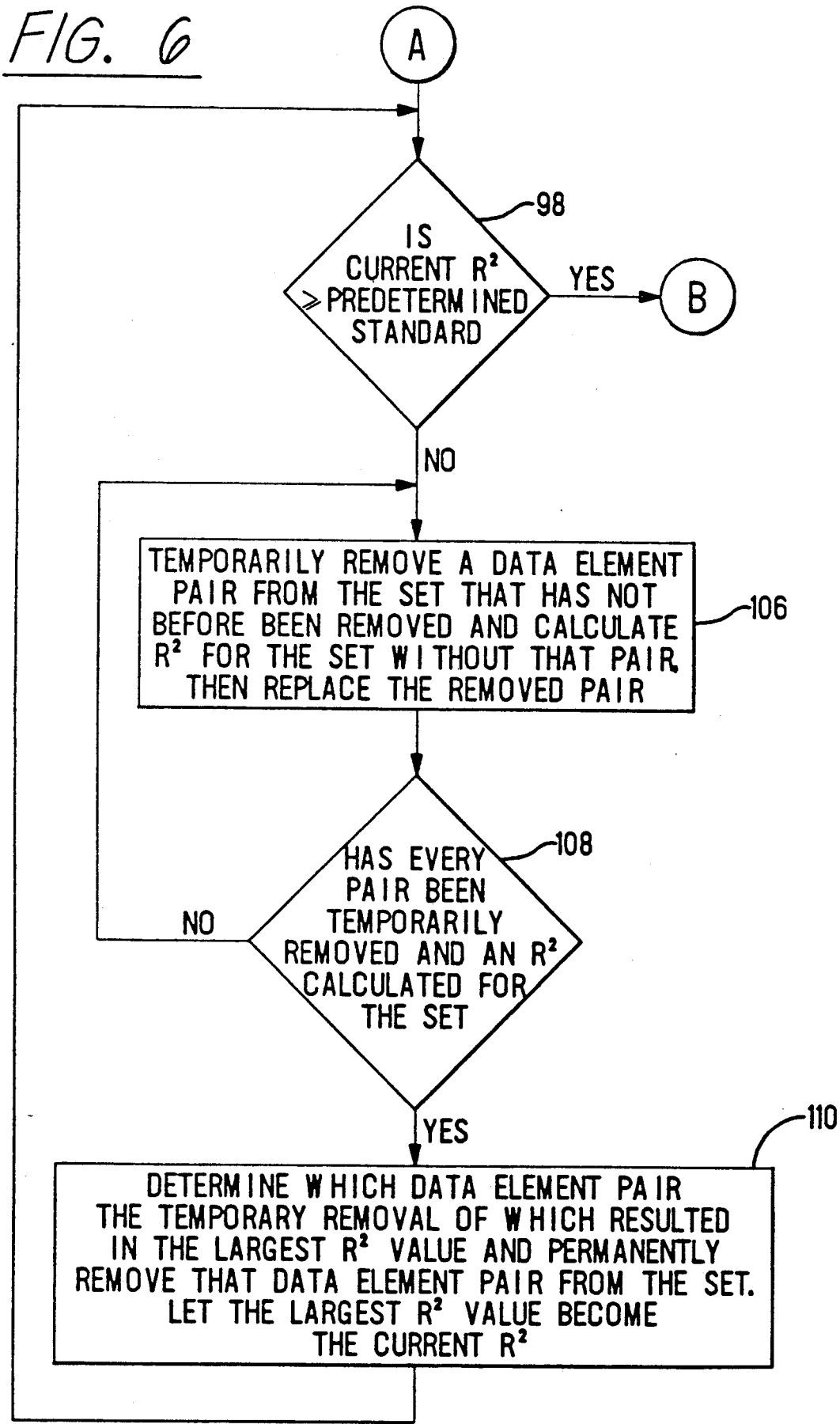
Figure 7:
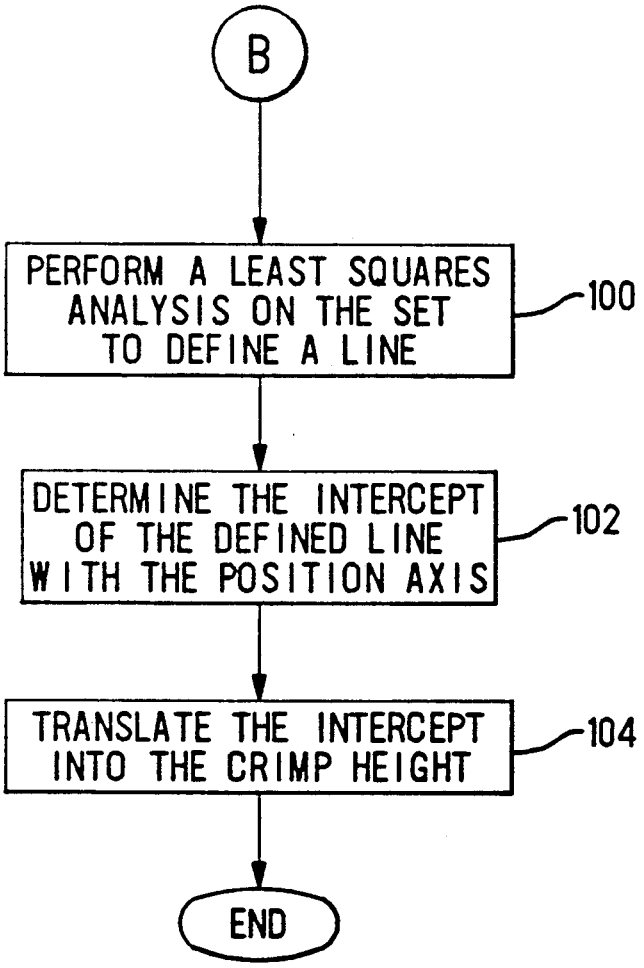

The method of the present invention is illustrated in the logic diagrams of FIGS. 5, 6, and 7. There, it is assumed that the press 10 has been calibrated as set forth above and that it is ready for production. A wire and associated terminal are placed in crimping position in the press 10 and crimped as indicated at 90 in FIG. 5. The force and position data element pairs resulting from the crimping operation are recorded by the computer 56 as indicated at 92. As indicated at 94, a set of these data element pairs are selected which occur after a predetermined peak force is attained and which have a force element within a predetermined range of the peak force. In the present example, as set forth above, a range of 10 percent to 65 percent of the peak force was used successfully. An $R^2$ value is then calculated for the set of data element pairs and called the current $R^2$ as indicated at 96. This current $R^2$ is then compared to a predetermined standard, as indicated at 98 of FIG. 6 which in the present example is 0.98, and if equal to or greater than that amount, a least squares analysis is performed on the set, as indicated at 100 of FIG. 7, to define a line that closely relates to the set of data element pairs. The intercept of the defined line with the position axis is then calculated, as indicated at 102 and then translated into crimp height as indicated at 104. In the event that the current $R^2$ is too small, that is, it is less than the predetermined standard, an iterative process, as set forth above, must be performed to obtain an acceptable $R^2$ value. This is shown at 106, 108, and 110 of FIG. 6. This process includes the removal of a data element pair from the set, calculating $R^2$ for the set without the removed data element pair, and then returning the pair to the set. This is done for all data element pairs in the set and then the data element pair, the removal of which resulted in the largest $R^2$ value is permanently removed from the set and that largest $R^2$ value becomes the current $R^2$. This current $R^2$ is then compared to the predetermining standard and if still too small, this iterative process 106, 108, and 110 is repeated.

An important advantage of the present invention is the capability to accurately determine the crimp height of a terminal being crimped during or immediately after the crimping process so that appropriate action may be taken in the event of a defective crimp, without necessarily adversely affecting the production rate of the press.

We claim:

1. In a method of determining the crimp height of an electrical terminal crimped onto a wire utilizing crimping apparatus which includes a press having a base and a ram arranged for opposing relative reciprocating motion, said base and ram each carrying a mating half of a crimping die set, the steps comprising:

(a) placing a terminal and wire in crimping position within said crimping apparatus;

(b) causing at least one of said base and said ram to undergo relative motion so that said die set engages, crimps said terminal onto said wire, and disengages;

(c) during said engaging, crimping, and disengaging of step (b), simultaneously measuring both the distance between the terminal engaging portions of said die set and the force applied to said terminal by said die set for a plurality of different relative positions of said mating halves of said die set thereby defining a plurality of measured force and position data element pairs having a force value and a position value respectively;

(d) examining said plurality of data element pairs and after a predetermined peak force is reached, selecting from the remaining data element pairs all of the pairs having a force value less than said peak force and greater than zero;

(e) performing a least squares analysis on said selected pairs to define a line;

(f) determining the intercept of said defined line with the position axis; and (g) translating said intercept into said crimp height.

2. The method according to claim 1 wherein steps (c) and (d) are performed substantially concurrently.

3. The method according to claim 1 wherein said selecting of step (d) is limited to selecting only data element pairs having a force value which is less than about 65 percent of said peak force and greater than about 10 percent of said peak force.

4. The method according to claim 3 wherein said predetermined peak force is the value of the maximum force of all of said plurality of data element pairs.

5. The method according to claim 1 including after step (d);

(d1) calculating a current $R^2$ value for the set of said selected data element pairs;

(d2) comparing said current $R^2$ value with a predetermined standard and if equal to or greater than said standard then proceeding to step (e).

6. The method according to claim 5 wherein if said current $R^2$ value is less than said standard then perform the following steps:

(d3) temporarily removing a data element pair from said set that has not before been removed and calculating $R^2$ for the set without that data element pair, then replacing the removed data element pair;

(d4) repeating step (d3) until every data element pair in said set has been temporarily removed and an associated $R^2$ calculated, and the data element pair returned to said set; and (d5) determining which data element pair, the temporary removal of which resulted in the largest $R^2$ value and permanently removing that data element pair from said set, then returning to step (d1).

7. The method according to claim 6 wherein said predetermined standard of step (d2) is about 0.98.

8. The method according to claim 1 wherein said defining a line in step (e) is limited to defining a substantially straight line.

9. The method according to claim 5 wherein if said current $R^2$ value is less than said standard then perform the following steps:

(d31) removing a data element pair from said set and calculating $R^2$ for the set without that data element pair;

(d32) comparing the calculated $R^2$ value with said predetermined standard and if equal to or greater than said standard then proceeding to step (e), otherwise repeating steps (d31) and (d32).

* * * * *